US007568962B2

(12) United States Patent
Amadio et al.

(10) Patent No.: US 7,568,962 B2
(45) Date of Patent: Aug. 4, 2009

(54) MODULAR TOY VEHICLE

(75) Inventors: Donald W. Amadio, Oaklyn, NJ (US); James V. Mendillo, Medford, NJ (US); Yuk Kei Chan, New Territories (HK)

(73) Assignee: Ridemakerz, LLC, Falls Church, VA (US)

( * ) Notice: Subject to any disclaimer, the term of this patent is extended or adjusted under 35 U.S.C. 154(b) by 42 days.

(21) Appl. No.: 11/735,980

(22) Filed: Apr. 16, 2007

(65) Prior Publication Data

US 2008/0254707 A1 Oct. 16, 2008

(51) Int. Cl.
*A63H 17/00* (2006.01)
*A63H 17/26* (2006.01)

(52) U.S. Cl. ..... 446/94; 446/95; 446/470; 446/471

(58) Field of Classification Search ..... 361/679, 361/724, 725, 727; 446/91, 94, 95, 431, 446/438, 456, 462, 465, 470, 471
See application file for complete search history.

(56) References Cited

U.S. PATENT DOCUMENTS 2,609,268 A * 9/1952 Nye ..... 312/332.1
2,691,724 A * 10/1954 Hoffman ..... 455/176.1
2,879,491 A * 3/1959 Shapiro ..... 439/62
3,094,364 A * 6/1963 Liagg ..... 439/247
3,696,548 A * 10/1972 Teller ..... 446/91
4,183,173 A 1/1980 Ogawa
4,188,748 A 2/1980 Rich et al.
4,236,190 A * 11/1980 Hollingsead et al. ..... 361/725
4,488,375 A * 12/1984 Cheng ..... 446/443
4,504,239 A 3/1985 Kulesza et al.
4,530,670 A * 7/1985 Ohno ..... 446/94
4,559,022 A 12/1985 Herstein et al.
4,571,202 A 2/1986 Diebold
4,919,639 A 4/1990 Hesse
4,993,983 A 2/1991 Kurita et al.
5,352,147 A 10/1994 Nagel et al.
6,033,285 A 3/2000 Fine et al.
6,364,509 B1 4/2002 Johnson, III
6,679,753 B1 1/2004 Motosko
6,758,718 B1 7/2004 Morris
6,773,321 B1 8/2004 Urquiaga
6,840,839 B2 1/2005 Rehkemper et al.
7,100,968 B2 9/2006 Mataja et al.

* cited by examiner

*Primary Examiner*—John Ricci
(74) *Attorney, Agent, or Firm*—Mark E. Stallion, Esq.; Husch Blackwell Sanders LLP

(57) ABSTRACT

A modular toy vehicle design having a universal mating system between the body of the vehicle and the chassis such that multiple body styles will interchangeably mate with multiple chassis designs and where electrical interfaces are automatically established between the body and the chassis simply by mating and aligning the two together. The design allows for an electrical connection to be made in the process of mechanically mating and aligning the body of a toy vehicle to its chassis thereby powering electronic features that are physically connected to the body with the power source which is housed in the chassis. When the body is properly aligned and mounted, the electrical interfaces are automatically established. There is no separate step of plugging together mating connectors where one connector extends from a wire bundle electrically interfacing with the body and the mating connector extends from a separate wire bundle electrically interfacing with the chassis.

11 Claims, 4 Drawing Sheets

MODULAR TOY VEHICLE

BACKGROUND OF INVENTION

1. Field of Invention

This invention relates generally to toy vehicles and, more particularly, to toy vehicles having a modular design.

2. Background Art

Radio-controlled (RC) cars as well as other toy cars, have been very popular with children of various ages over the years. However, a disadvantage of many toy cars is that generally speaking they are fixed in design and cannot be changed. This means that a child can often become bored with them after a period of time. Furthermore, many children express satisfaction with being able to build or work on a toy themselves. Yet, many radio-controlled cars and other toy cars have a complex construction and have components which are complicated and not easily adapted to be built or switched out by children. What is needed is a toy vehicle having universally and easily interchangeable components such that a child may be able to build or customize their own toys.

Attempts have been made to design toy vehicles with interchangeable components, however, the interchangeable modules for a given vehicle design can each have a distinctly different attachment mechanisms. For example, for a given vehicle, there can be multiple types of attachment mechanisms for the front bumper area of the vehicle and a totally different set of attachment mechanisms for the sides and rear of the vehicle. A more simple design is needed for attachments and accessories where the attachment mechanisms are more universal and easy for children of all ages to install.

Attempts have been made to develop less complex designs and with more universal attachment mechanisms, however, the designs are quite convoluted in that a child can place any accessory at any location on the toy vehicles even at locations where the accessory is not intended to be installed. A design is needed where the attachment mechanisms are universal, but the design is such that accessories can only be installed at their intended locations. Further, many attempts to develop a design that addresses this need has resulted in a design with a less than appealing appearance having unsightly holes or contact points at locations that take away from the appearance of the vehicle, particularly when an accessory is not installed. This is particularly important when the owner of the toy vehicle is concerned about whether the appearance of the vehicle closely mimics the appearance of a full size vehicle. Unsightly holes or contact points all over the vehicle negates the attempt to mimic the appearance of a full size vehicle.

Further, the attempts to develop a design having interchangeable accessories and attachments have not provided mechanisms for supplying power to accessories, such as for example, providing power to accessories having LED lights and/or sound emitting devices. There are various toy vehicle designs that exist that include light emitting and/or sound emitting devices, however, these devices are not interchangeable accessories.

BRIEF SUMMARY OF INVENTION

The invention is a modular toy vehicle design having a universal mating system between the body of the vehicle and the chassis such that multiple body styles will interchangeably mate with multiple chassis designs and where electrical interfaces are automatically established between the body and the chassis simply by mating and aligning the two together. The design allows for an electrical connection to be made in the process of mechanically mating and aligning the body of a toy vehicle to its chassis thereby powering electronic features that are physically connected to the body with the power source which is housed in the chassis. When the electrical interfaces of the body and chassis are properly aligned and connected, the electrical interfaces are automatically established and the body and chassis are automatically properly aligned, including the chassis mounting posts and body mounting posts. There is no separate step of plugging together mating connectors where one connector extends from a wire bundle electrically interfacing with the body and the mating connector extends from a separate wire bundle electrically interfacing with the chassis.

The present invention is designed for a business model where the toy vehicle bodies can be sold separately from the chassis, giving the customer a choice of several chassis on which to attach a selected vehicle body. The vehicle bodies can have built in working LED headlights and tail lights, but no power source. The power source can be contained within the various chassis designs. The body can also have a sound initiation button such that when the button is depressed and the vehicle body and chassis are properly aligned, the initiation button will electrically contact a mating contact on the chassis to initiate a function, for example, a lighting/sound/motion sequence.

Traditionally, the connection chassis and boy are made by male and female connector clips which are attached to the power source and the wire leads for the lights, respectively. This is a practical solution for a business model where the chassis and body can be sold separately. This requires that the user be in direct contact with wiring and also results in loose hanging electrical wires within the vehicle housing, which can be unsightly and a potential shock hazard, and more susceptible to damage.

The purpose of the automatic mating of the power connector is three-fold; safety, aesthetics and, most importantly, as a guide to assist in the proper alignment of the male and female connection posts between the vehicle body and chassis. So when the power connector's male and female parts are mated, all other connecting points also mate perfectly thereby making for a true connection between the upper body and lower chassis.

The design assists in proper alignment of connection posts 1; provides large, easy to attach connectors 2 (as compared to typical small battery connectors); eliminates the need for separate power sources; and is shock resistant. Plastic toy vehicles typically consist of two main parts; the body 3 and the chassis 4 (which contains the wheels, motor, etc. These two parts are typically connected by a number of strategically positioned posts (for structural integrity). These posts have male and female ends that mate and are held together by small screws. This assembly operation is usually done in factories and not by the end user.

Toy vehicles with electronic features require a power source and wiring that runs from the power source to the electronic component. Again, this is usually done at the factory level and the end user has little if any direct involvement with electronic wiring. In cases when there is a need for the consumer to complete a connection, the manufacturer builds in small plastic connectors that the consumer can connect. This can often be frustrating because the connectors are small and are often difficult to attach and detach.

The present business model requires that the toy vehicle bodies and chassis be sold separately. So there is the problem of relying on the consumer (often children ages 6 and up in our case) to properly align the body and chassis posts and to make the necessary electrical connections.

The design consists of oversized male 5 and female 2 electronic connectors that are molded into the chassis and vehicle body respectively. Wire leads run from the battery compartment through the interior of the chassis into the male electrical connector. Similarly, wire leads 6 from the electronic components inside the body are connected to the female electrical connector 2 attached to the body. When the two connectors are mated, the posts 1 on the body and chassis alternately align, thereby ensuring a true connection between the two parts.

The elimination of any exposed wires running from the batter source greatly reduce the potential for shock. Also, there is no danger of shock by touching copper conductors on the male contact. The sound initiation push button 7 can be aligned with contact 8 on the chassis. Please refer to the enclosed drawings for further details relating to this invention.

These and other advantageous features of the present invention will be in part apparent and in part pointed out herein below.

BRIEF DESCRIPTION OF THE DRAWINGS

For a better understanding of the present invention, reference may be made to the accompanying drawings in which.

Figure 1:
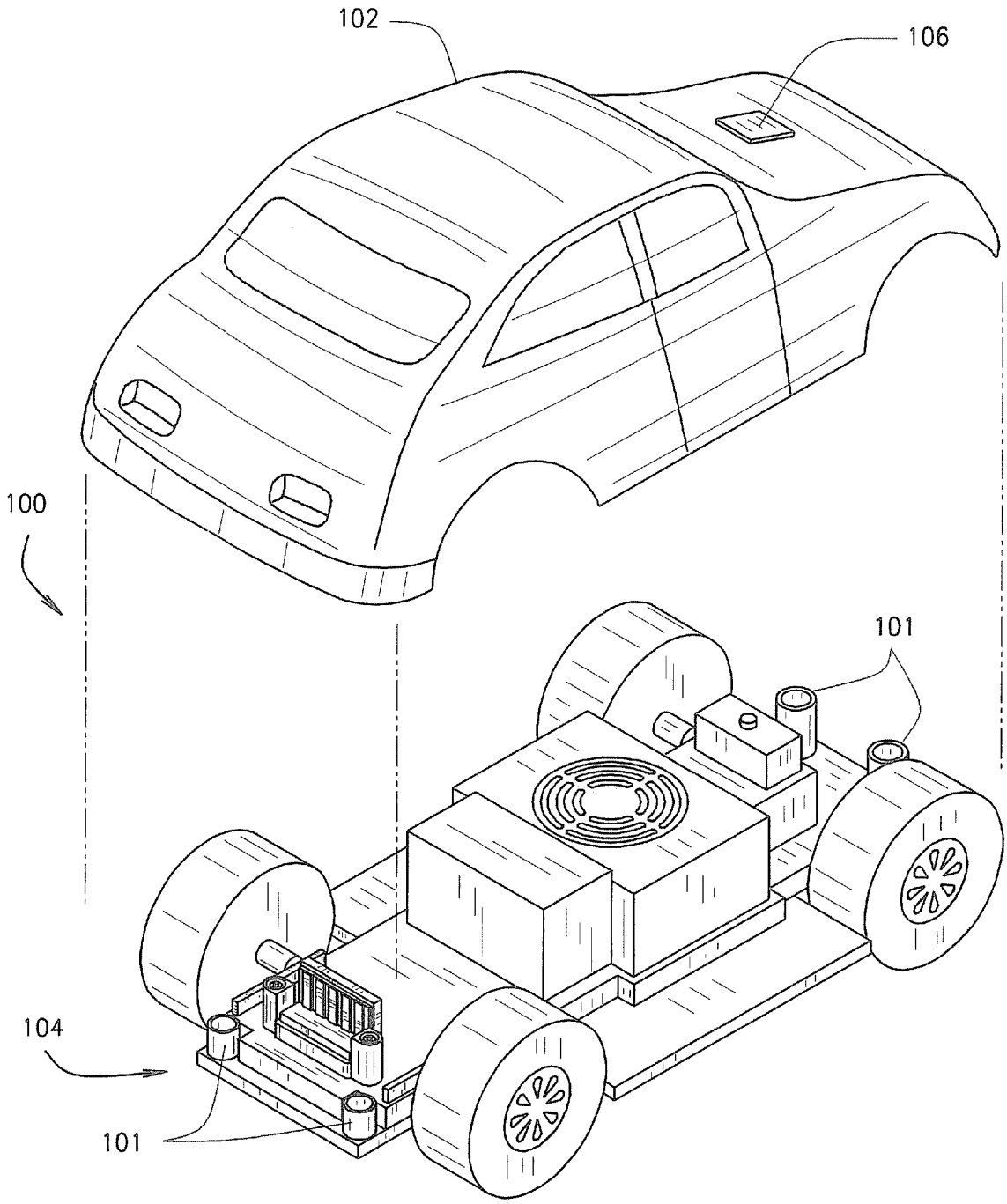
FIG. 1 is top-side exploded perspective view of a body and chassis.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF INVENTION

According to the embodiment(s) of the present invention, various views are illustrated in FIG. 1-7 and like reference numerals are being used consistently throughout to refer to like and corresponding parts of the invention for all of the various views and figures of the drawing. Also, please note that the first digit(s) of the reference number for a given item or part of the invention should correspond to the Fig. number in which the item or part is first identified.

One embodiment of the present invention comprising a modular body and chassis teaches a novel apparatus and method for a toy vehicle having a universal mating system between the body of the vehicle and the chassis such that multiple body styles will interchangeably mate with multiple chassis designs and where electrical interfaces are automatically established between the body and the chassis simply by mating and aligning the two together.

Figure 2:
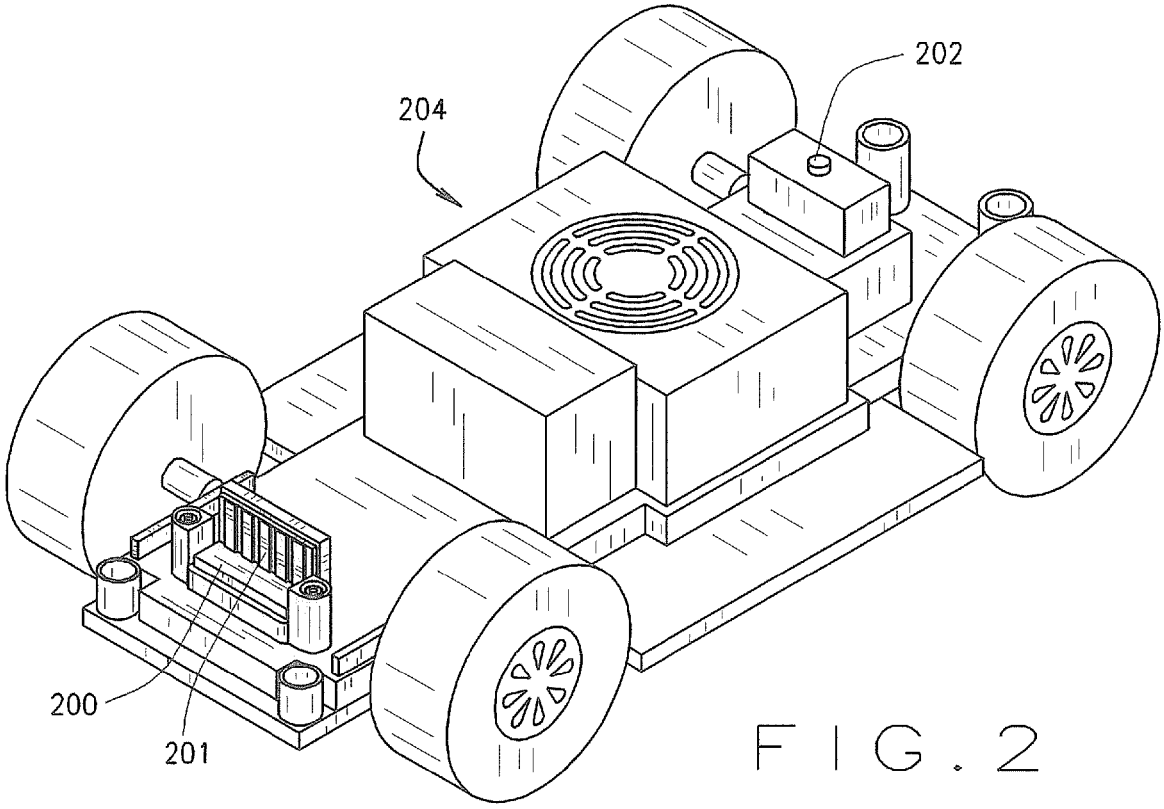
FIG. 2 is a top-side perspective view of the chassis.
Figure 3:
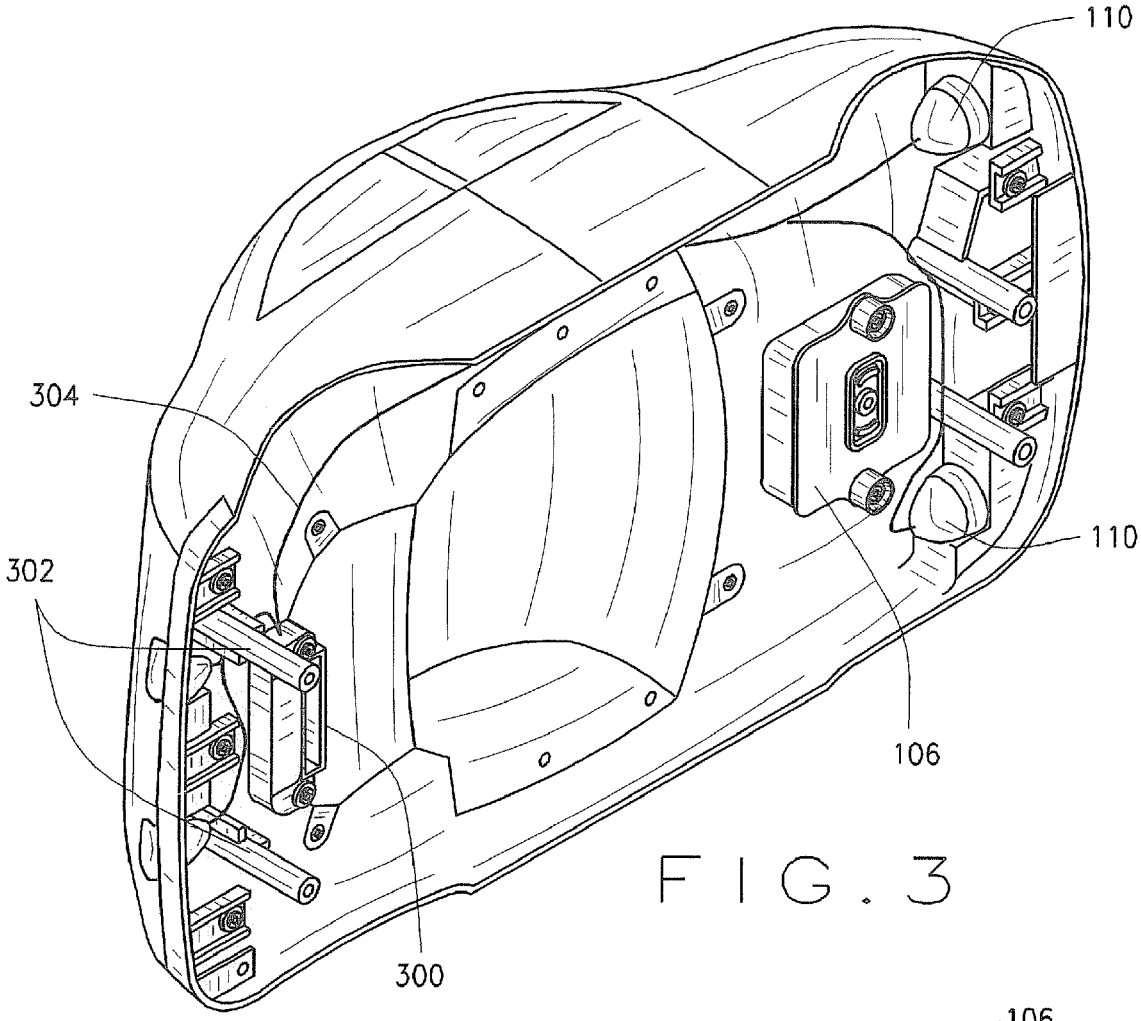
FIG. 3 is a bottom-side perspective view of the body.
Figure 4:
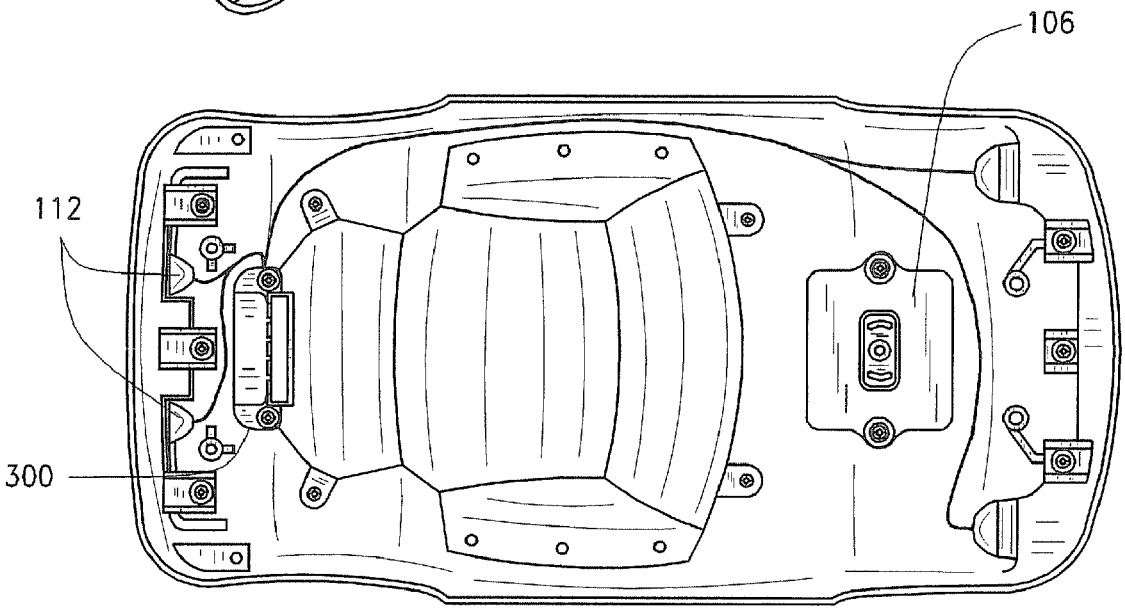
FIG. 4 is a bottom plan view of the body.

The details of the invention and various embodiments can be better understood by referring to the figures of the drawing. Referring to FIG. 1, an exploded top side perspective view of a body and chassis is shown. The exploded view of a toy vehicle 100 reveals a body portion 102 and a chassis portion 104. The body is mountable over the chassis as shown. The body can be designed for various car styles thereby giving the toy vehicle a certain exterior appearance. The vehicle chassis provides for vehicle mobility. The chassis can typically include four wheels and the wheels can be powered by a motor contained in the chassis or the wheels can be free rotating wheels that requires the user to push the vehicle to initiate mobility. The chassis can also have a vehicle power source as needed. The toy vehicle can also include a sound initiation actuator 106, shown here as being generally located in the area which can be referred to as the hood area. When this actuator is depressed, the toy vehicle can initiate a sound sequence. This exploded view also reveals the chassis mounting post 101 through which screws are threaded for attaching the body to the chassis. The body can also include headlights 110 and taillights 112 that can be powered by the chassis power source. An electrical connection between the chassis and the vehicle body can be established when the electrical interfaces are properly aligned and the body and chasses are properly aligned and mounted. The electrical connection allows for power to be provided to the headlights 110 and the taillights 112. The body could include various other lights that could also be powered after connection between the chassis and body has been established. Referring to FIG. 2, a topside perspective view of the chassis is shown. The chassis can include a chassis connector 200. The embodiment of the chassis connector 200 shown is configured as a protruding tab that can be inserted into a female connector located on the vehicle body. The tab-like connector extends upward from the vehicle chassis in order to properly engage the mated connector located on the body. This view of the chassis also reveals the sound button 202 that can be aligned and contacted by the sound initiation actuator 106 when it is depressed downward. When the sound initiation actuator 106 is depressed, it will contact the sound button 202 thereby depressing the sound button to initiate a sound sequence. A power source 204 is also located in the chassis. The power signals as well as control signals can be sent from the chassis through the chassis connector 200 to the vehicle body. The connector 200 can have multiple contacts for transmitting various signal types. FIG. 3 shows a bottom side perspective view of the body which reveals the mating body connector 300 that is designed to receive the chassis connector 200. The body connector 300 shall include corresponding contacts 301 for mating with the contacts 201 of the chassis connector. This view of the body also reveals the body mounting post 302 whereby the body can be mounted on the chassis by way of a screw or other attachment means. This view also reveals the electrical lines 304 that extend from the body connector to the respective lights or other items requiring power. FIG. 4 is a further illustration providing a bottom plan view of the vehicle body. FIG. 5 is yet again another further illustration revealing the chassis design.

Figure 5:
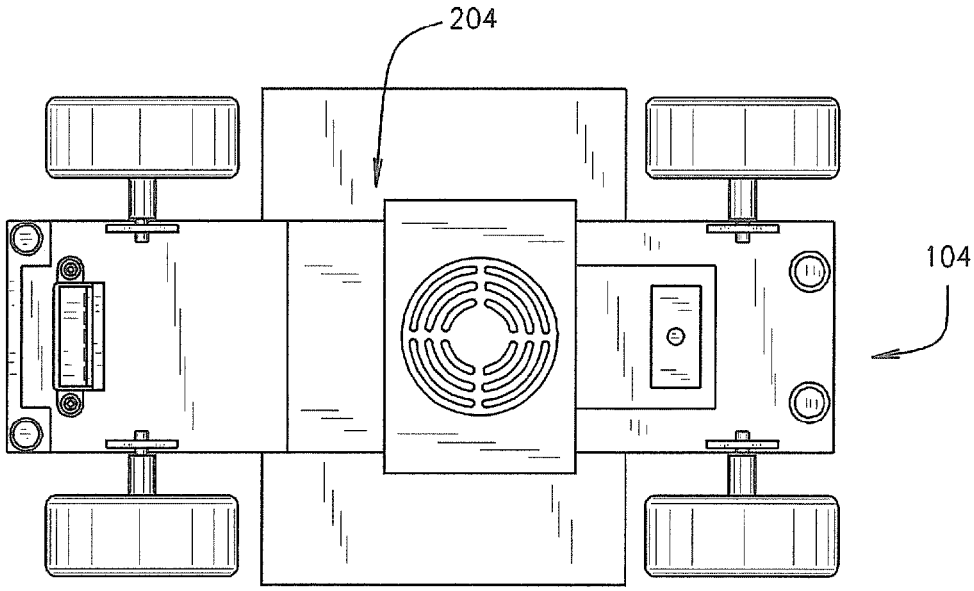
FIG. 5 is a top plan view of the chassis.
Figure 6:
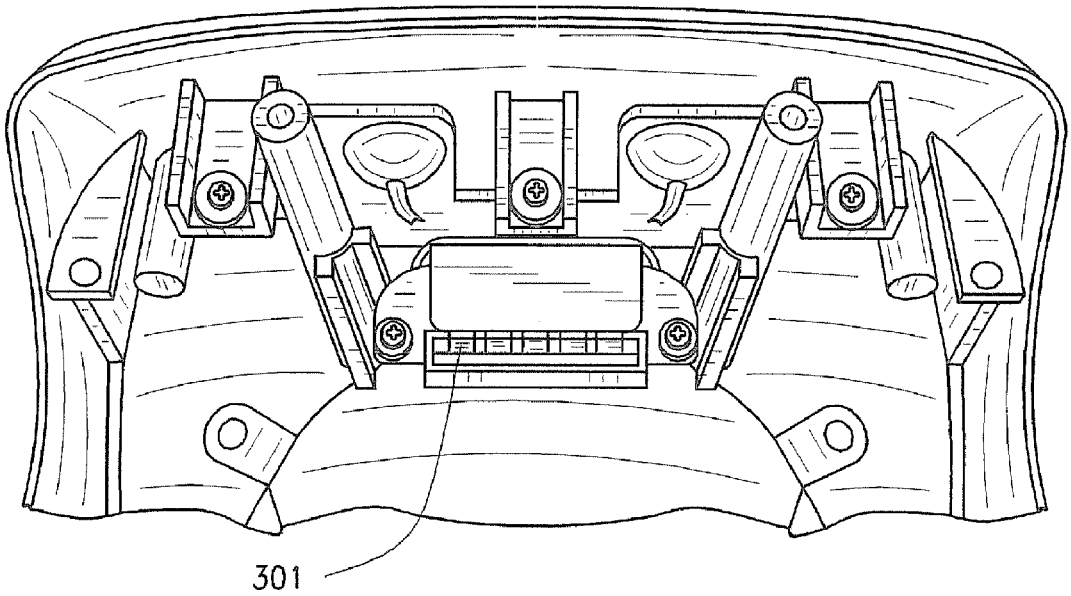
FIG. 6 is a perspective view of the connector.
Figure 7:
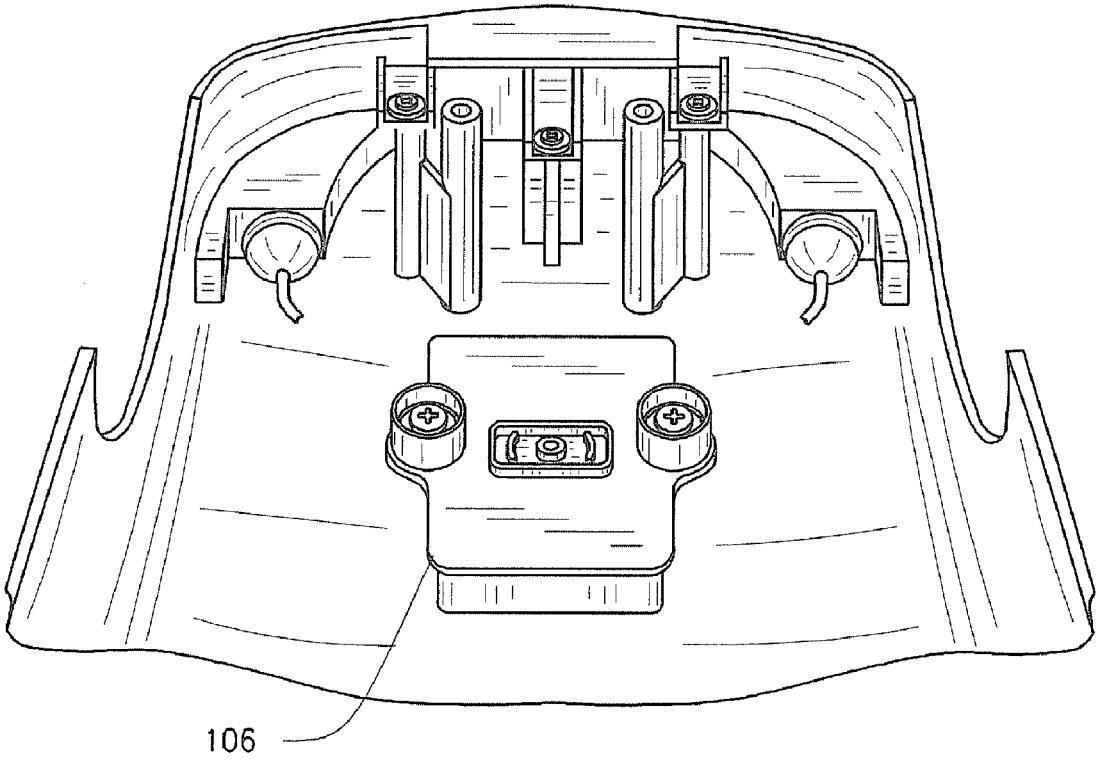
FIG. 7 is a perspective view of the sound initiation push button.

Referring to FIG. 6, a perspective view of the chassis connector is shown. This flattened tab-like connector 200 can have exterior surface contacts 201 as shown. These surface contacts can be thin copper runs or other types of contacts that can make electrical contact with the corresponding contacts 301 of the body connector. When the vehicle is properly aligned and mounted, the chassis connector and the body connector will properly mate. A perspective view of the sound button 106 is also shown in FIGS. 2 and 5. This sound button is also properly aligned with the sound initiation actuator 106 attached to the vehicle body. When this sound button is depressed, the vehicle can be initiated to produce a sequence of sounds that are previously stored.

The various modular toy vehicle examples shown above illustrate a novel design for a vehicle having interchangeable bodies. A user of the present invention may choose any of the above modular vehicle embodiments, or an equivalent thereof, depending upon the desired application. In this regard, it is recognized that various forms of the subject modular vehicle invention could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the sprit and scope of the present invention.

Other aspects, objects and advantages of the present invention can be obtained from a study of the drawings, the disclosure and the appended claims.

What is claimed is:

1. A modular toy vehicle comprising:

a toy vehicle body having a body alignment electrical connector interface extending from the interior body underside and having a first guide member defining a first mechanical line of engagement, said body alignment electrical connector mounted to and aligned with the toy vehicle body aligning the first mechanical line of engagement to be congruent with a first predetermined line of engagement, said first guide member comprising a first electrical contact disposed thereon;

a toy vehicle chassis having a chassis alignment electrical connector interface mateable to said body alignment electrical connector interface extending from a top of the chassis and having a second guide member defining a second mechanical line of engagement, said chassis alignment electrical connector mounted to and aligned with the toy vehicle chassis aligning the second mechanical line of engagement to be congruent with a second predetermined line of engagement, said second guide member comprising a second electrical contact disposed thereon;

said body alignment electrical connector interface mated with said chassis alignment electrical connector interface aligning congruently the first and second predetermined lines of engagement thereby automatically aligning and mounting the vehicle body and chassis while concurrently providing an electrical connection between said first electrical contact and said second electrical contact to provide power between said body and said chassis; and an actuator button operatively attached to the toy vehicle body having a range of motion from a non-contact position to a contact position where when said actuator button is depressed to said contact position said actuator button depresses a button on said chassis initiating a predetermined action.

2. The modular toy vehicle as recited in claim 1, further comprising:

a first mounting post extending from said body having a first lengthwise interior cylindrical bore having congruent cylindrical axis with a second mounting post extending from said chassis having a second lengthwise interior cylindrical bore for attaching the body and chassis with a screw.

3. The modular toy vehicle as recited in claim 2, where said first guide member is a tab and the second guide member is a guide slot.

4. A method for assembly of a modular toy vehicle comprising the steps of:

providing a toy vehicle body having a body alignment electrical connector interface extending from the interior body underside and having a first guide member defining a first mechanical line of engagement, said body alignment electrical connector mounted to and aligned with the toy vehicle body aligning the first mechanical line of engagement to be congruent with a first predetermined line of engagement;

providing a toy vehicle chassis having a chassis alignment electrical connector interface mateable to said body alignment electrical connector interface extending from a top of the chassis and having a second guide member defining a second mechanical line of engagement, said chassis alignment electrical connector mounted to and aligned with the toy vehicle chassis aligning the second mechanical line of engagement to be congruent with a second predetermined line of engagement;

mating said body alignment electrical connector interface with said chassis alignment electrical connector interface and aligning congruently the first and second predetermined lines of engagement thereby automatically aligning and mounting the vehicle body and chassis; and providing an actuator button operatively attached to the toy vehicle body having a range of motion from a non-contact position to a contact position where when said actuator button is depressed to said contact position said actuator button depresses a button on said chassis initiating a predetermined action.

5. The method of assembly of a modular toy vehicle as recited in claim 4, further comprising the step of:

electrically contacting at least one body connector contact with at least one chassis connector contact transmitting power from a power source contained in said chassis to a light attached on said body.

6. The method of assembly of a modular toy vehicle as recited in claim 4, further comprising the steps of:

providing a first mounting post extending from said body having a first lengthwise interior cylindrical bore having congruent cylindrical axis with a second mounting post extending from said chassis having a second lengthwise interior cylindrical bore for attaching the body and chassis with a screw.

7. The method of assembly of a modular toy vehicle as recited in claim 4, where said first guide member is a tab and the second guide member is a guide slot.

8. A modular toy vehicle comprising:

a toy vehicle body having a body alignment electrical connector interface extending from the interior body underside and having a first guide member defining a first mechanical line of engagement, said body alignment electrical connector mounted to and aligned with the toy vehicle body aligning the first mechanical line of engagement to be congruent with a first predetermined line of engagement;

a toy vehicle chassis having a chassis alignment electrical connector interface mateable to said body alignment electrical connector interface extending from a top of the chassis and having a second guide member defining a second mechanical line of engagement, said chassis alignment electrical connector mounted to and aligned with the toy vehicle chassis aligning the second mechanical line of engagement to be congruent with a second predetermined line of engagement;

said body alignment electrical connector interface mated with said chassis alignment electrical connector interface aligning congruently the first and second predetermined lines of engagement thereby automatically aligning and mounting the vehicle body and chassis; and an actuator button operatively attached to the toy vehicle body having a range of motion from a non-contact position to a contact position where when said actuator button is depressed to said contact position said actuator button depresses a button on said chassis initiating a predetermined action.

9. The modular toy vehicle as recited in claim 8, where at least one body connector contact electrically contacts at least one chassis connector contact transmitting power from a power source contained in said chassis to a light attached on said body.

10. The modular toy vehicle as recited in claim 8, further comprising:

a first mounting post extending from said body having a first lengthwise interior cylindrical bore having congruent cylindrical axis with a second mounting post extending from said chassis having a second lengthwise interior cylindrical bore for attaching the body and chassis with a screw.

11. The modular toy vehicle as recited in claim 8, where said first guide member is a tab and the second guide member is a guide slot.

* * * * *